United States Patent [19]

Riehl et al.

[11] Patent Number: 4,917,121

[45] Date of Patent: Apr. 17, 1990

[54] SMOKING ARTICLE

[75] Inventors: Tilford F. Riehl; Robert R. Johnson, both of Louisville, Ky.

[73] Assignee: Brown & Williamson Tobacco Corporation, Louisville, Ky.

[21] Appl. No.: 281,583

[22] Filed: Dec. 9, 1988

[51] Int. Cl.[4] ..... A24B 15/28; A24D 1/18

[52] U.S. Cl. ..... 131/364; 131/361; 131/360; 131/194

[58] Field of Search ..... 131/364, 360, 361, 359, 131/369, 194

[56] References Cited

U.S. PATENT DOCUMENTS 2,979,058 4/1961 Schur ..... 131/331

4,714,082 12/1987 Banerjee et al. ..... 131/359

FOREIGN PATENT DOCUMENTS 1203172 10/1965 Fed. Rep. of Germany ..... 131/331

*Primary Examiner*—V. Millin

*Attorney, Agent, or Firm*—Charles G. Lamb

[57] ABSTRACT

A smoking article includes a tobacco column with a gas impermeable tube concentrically located in the tobacco column. The tube is filled with a granular material which is coated with an aerosolizing material. A first chamber is located at one end of the tobacco column with its inlet end in gas flow communication only with the tube, a tobacco rod is located with its inlet end at the discharge end of the first channel, and a second chamber is located in gas flow communication with the discharge end of the tobacco rod. The discharge end of the second chamber is open for discharging gas into the smoker's mouth.

9 Claims, 1 Drawing Sheet

SMOKING ARTICLE

BACKGROUND OF THE INVENTION

The present invention relates to smoking devices, and more particularly, to a smoking article which includes flavor releasing material and aerosol generating material which are volatilized by the heat generated by burning tobacco, but are not directly subjected to the burning tobacco.

Smoking articles having a tobacco column with a tubular member therethrough, wherein the tube is filled with an aerosol releasing material, are known. The following patents illustrate various known smoking articles of this type: U.S. Pat. No. 3,258,015 issued on June 28, 1966 to C. D. Ellis, et al.; U.S. Pat. No. 3,356,094 issued on Dec. 5, 1967 to C. D. Ellis, et al.; U.S. Pat. No. 4,340,072 issued on July 20, 1982 to Bolt, et al.; U.S. Pat. No. 4,714,082 issued on Dec. 22, 1987 to Chandra K. Banerjee, et al.; U.S. Pat. No. 4,715,389 issued on Dec. 29, 1987 to Dwo Lynn, et al.; and U.S. Pat. No. 4,732,168 issued on Mar. 22, 1988 to James L. Resce, et al.

In U.S. Pat. Nos. 3,356,094; 4,340,072 and 4,732,168, smoke from the burning tobacco is mixed with the aerosol and delivered to the smoker's mouth. In U.S. Pat. No. 4,715,389, a tobacco column has a central channel which holds a plug of carbonized tobacco with plugs of aluminum screen to both sides of the tobacco plug. Both smoke from the tobacco column and pyrolized products of the carbonized tobacco plug are delivered to the smoker's mouth. In U.S. Pat. No. 3,258,015, the aerosol from a nicotine-releasing composition located within a central tube passes through a nucleating chamber wherein the aerosol is cooled and condensed to droplets before being discharged to the smoker's mouth.

SUMMARY OF THE INVENTION

The present invention provides a straight forward arrangement of a smoking device vaporizing a flavor material. The present invention further provides a smoking device utilizing a fuel element circumscribing a flavor releasing material. The present invention even further provides a smoking device utilizing a fuel element circumscribing a flavor releasing material, the flavor releasing material when vaporized being in flow communication with tobacco.

Also, the present invention provides a smoking device having a central tube of an impermeable material located within a tobacco column wherein the tube is fabricated of a gas impermeable material filled with a granular material which is coated with an aerosolizing material.

Various other features of the present invention become obvious to those skilled in the art upon reading the disclosure set forth hereinafter.

More particularly, the present invention provides a smoking article comprising a tobacco column, a wrapper circumscribing the tobacco column, a tube fabricated of a gas impermeable material concentrically located within the tobacco column and extending substantially the entire length of the tobacco column, the open ends of the tube defining inlet and outlet ends of said tobacco column, a granular material filling the tube, an aerosol generating material coating the granular material filling the tube, means defining a first chamber adjacent the outlet end of the tobacco column in flow communication only with the tube, a tobacco rod coaxially located at the opposite end of the first chamber from the tobacco column, and means defining a second chamber at the end of the tobacco rod opposite the first chamber in flow communication with the tobacco rod.

BRIEF DESCRIPTION OF THE DRAWINGS

A better understanding of the invention will be had upon reference to the following description in conjunction with the accompanying drawings wherein the numerals refer to like parts throughout the several views and wherein.

DETAILED DESCRIPTION OF THE PREFERRED EMBODIMENTS

Figure 1:
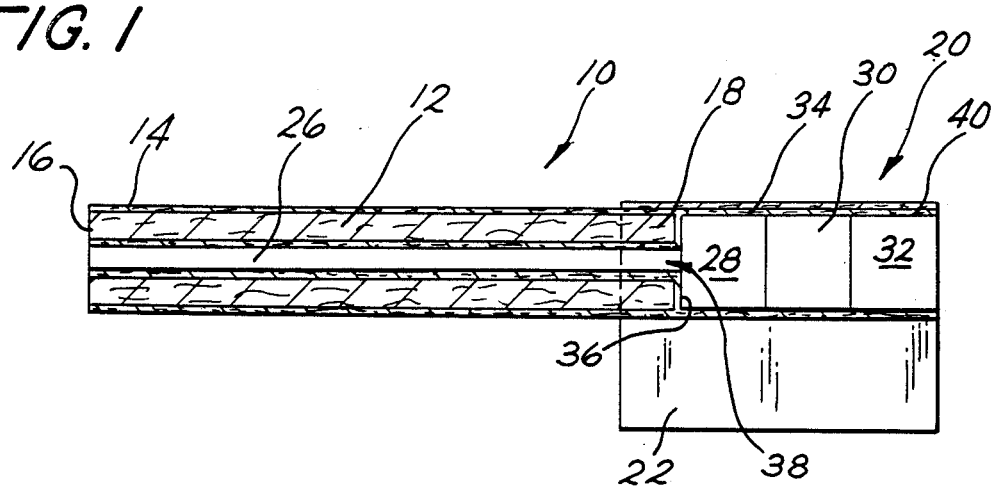
FIG. 1 is a longitudinal cross-sectional view of one embodiment of the present invention.

With reference to FIG. 1, there is shown a smoking device, generally denoted as the numeral 10, of the present invention. The smoking device 10 comprises a generally cylindrical tobacco column 12 circumferentially wrapped with a paper wrapper 14. The paper wrapper 14 is preferably of the type having a controlled burning rate which emits little visible smoke, commonly referred to as sidestream smoke. The wrapped tobacco column 12 has opposed flow through ends, inlet end 16 and outlet end 18. A mouthpiece generally denoted as the number 20 is coaxially located at the outlet end 18 of the wrapped tobacco column 12 and is connected thereto by a circumscribing tipping material 2 which overlaps the adjacent end of the tobacco column 12. A rigid, gas impermeable, frangible or combustible tube 24 is concentrically located within the tobacco column 12 and extends the entire length of the tobacco column 12 so that the tube 24 is open at one of its ends to the end 16 of the tobacco column 12 and open at the other of its ends to the outlet end 18 of the tobacco column 12. The impermeable gas tube 24 is friable at the temperature of the burning tobacco of the tobacco column 12. The tube 24 is filled with a non-tobacco granular material 26, such as alumina or a substantially non-combustible charcoal, and the like. The granular material 26 is coated with an aerosol generating material such as, for example, glycerin and lactic acid or lipophilic materials such as methyl palmitate, and the like which aerosolizes at the temperature of the burning tobacco. The granular material 26 can also be coated with a flavor releasing material containing, for example, a nicotine extract, menthol, and the like, which vaporizes at the temperature of the burning tobacco.

With reference to FIG. 1, the mouthpiece 20 comprises a first cooling chamber 28, an intermediate tobacco rod 30, and a cooling second chamber 32. A first cylindrical body 34 located at the outlet end 18 of the tobacco column 12 defines the first chamber 28 with its inlet end in flow communication only with the tube 24, but not the tobacco column 12. Toward this objective, a barrier or seal 36 is located at the interface of the cylindrical body 34 and tobacco column outlet end 18. The seal 36 has an opening 38 therethrough which registers with the tube end to provide for the flow of aerosol from the tube 24 into the first chamber 28 while preventing the flow of smoke from the tobacco column 12 into the first chamber 28. The tobacco rod 30 is coaxially located at the outlet end of the first chamber 28 to receive the aerosol therefrom. A second cylindrical body 40 located at the outlet end of the tobacco rod 30 defines the second chamber 32 with its inlet end in fluid flow communication with the tobacco rod 30 to receive the aerosol from the tobacco rod 30.

Figure 2:
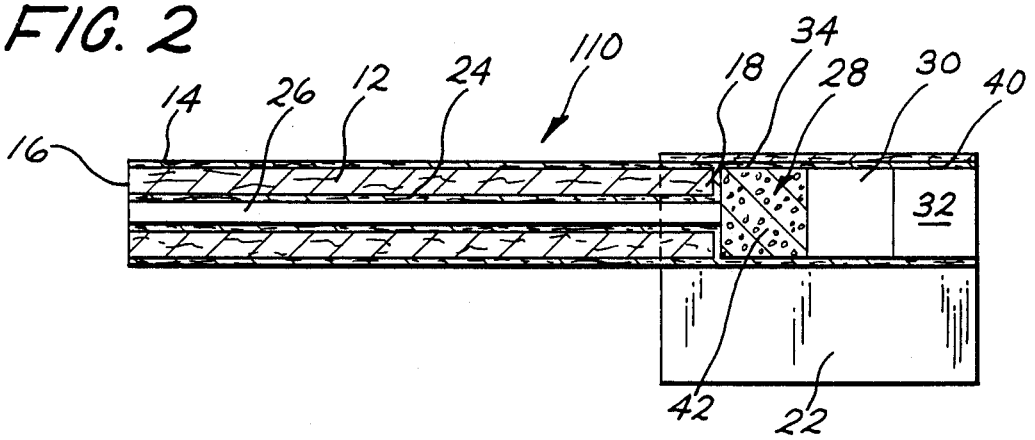
FIG. 2 is a longitudinal cross-sectional view of another embodiment of the present invention; and, FIG. 3 is a longitudinal cross-sectional view of yet another embodiment of the present invention.

Referring now to FIG. 2, there is shown a smoking device, generally denoted as the numeral 110, which has a mouthpiece 120 essentially identical to the mouthpiece 20 of the smoking device 10 of FIG. 1 except for one feature, and, therefore, for the sake of brevity the common features are identified by identical numerals and the description thereof will not be repeated. In comparing the mouthpiece 120 to the mouthpiece 20, the only difference is that in the mouthpiece 120 the first chamber 28 is filled with a smoke dispersing granular material 42. The granular material can be of the same type filling as the tube 24. Also, the granular material 42 can be coated with an aerosolizing material such as, for example, glycerin and lactic acid. Even further, the granular material can be coated with a flavor releasing material such as, for example, a nicotine extract or menthol.

Figure 3:
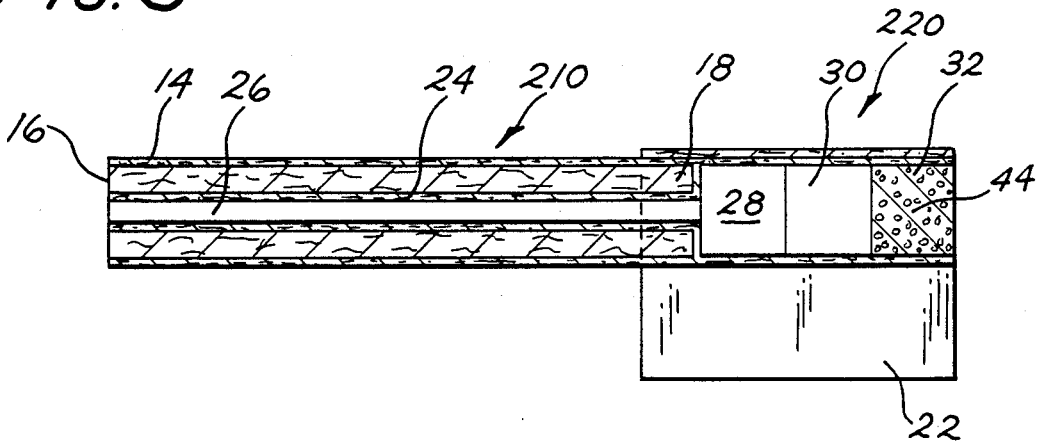

Referring now to FIG. 3, there is shown a smoking device, generally denoted as the numeral 210, which has a mouthpiece 220 essentially identical to both the mouthpiece 20 of smoking article 10 and mouthpiece 120 of smoking article 110 except for one feature and, therefore, for the sake of brevity, the common features are identified by identical numerals and the description thereof will not be repeated. In comparing the mouthpiece 220 to the mouthpiece 120, the only difference is that in the mouthpiece 220 the second chamber 32 is filled with a filter material 44, such as a cellulose acetate filter, commonly used to filter smoke in conventional cigarettes.

In smoking the smoking article 10, the smoker draws on the open end of the second chamber 32 which causes ambient air to be drawn into the open end of the tube 24 at the lighted end 16 of the tobacco column 12. The air heated by the smoldering, burning tobacco of the tobacco column 12 passes along the tube 22 wherein it aerosolizes the aerosol forming material and vaporizes the flavor releasing material (if such is included) on the granular material 26. The aerosol then passes through the opening 38 in the seal 36 into the first chamber 28 which causes the relatively narrow stream of aerosol to disperse so that the dispersed aerosol will substantially uniformly pass through the tobacco rod 30 as it picks up the nicotine and tobacco flavors of the tobacco rod 30. the aerosol from the tobacco rod 30 then passes through the second chamber 32 and into the smoker's mouth.

In smoking the smoking article 110, the sequence of events is as described above except that when the aerosol passes through the granular material 42 in the first chamber 28, it is not only dispersed but also aerosolizes the aerosol generating material on the granular material 42, and also vaporizes the flavor releasing material on the granular material 42 is used, thus enriching the aerosol before it enters the tobacco rod.

In smoking the smoking article 210, the sequence of events is as described above except that the aerosol leaving the tobacco rod 30 is filtered as it passes through the filter material 44 in the second chamber 32 before it enters the smoker's mouth.

The foregoing detailed description is given primarily for clearness of understanding and no unnecessary limitations are to be understood therefrom for modification will become known to those skilled in the art upon reading this disclosure and may be made without departing from the spirit of the invention and scope of the appended claims.

What is claimed is:

1. A smoking article comprising:
a tobacco column as a fuel source;
a wrapper circumscribing the tobacco column;
a tube fabricated of gas impermeable material concentrically located within the tobacco column and extending substantially the entire length of the tobacco column, said tube having one end open to the inlet end of said tobacco column and the other end open to the outlet end of said tobacco column;
a granular material filling the tube;
an aerosol generating material coating the granular material in the tube;
a first chamber adjacent the outlet end of the tobacco column with inlet gas flow communication only with the tube;
a tobacco rod coaxially located at the end of the first chamber opposite the tobacco column; and,
a second chamber at flow communication with the tobacco rod.

2. The smoking article of claim 1, wherein the granular material in the tube is coated with a flavor releasing material.

3. The smoking article of claim 1, wherein the first chamber is filled with a granular material.

4. The smoking article of claim 3, wherein the granular material in the first chamber is coated with an aerosol generating material.

5. The smoking article of claim 4, wherein the granular material in the first chamber is coated with a flavor releasing material.

6. The smoking article of claim 1, wherein the second chamber is filled with a filter material.

7. The smoking article of claim 1, further comprising a seal at the outlet end of the tobacco column to prevent smoke from passing out of the outlet end of the tobacco column into the first chamber for preventing smoke from the tobacco column from passing to the smoker's mouth.

8. The smoking article of claim 1, wherein the tube is fabricated of a frangible.

9. The smoking article of claim 1, wherein the tube is fabricated of a combustible material.

* * * * *